US006257565B1

(12) United States Patent
Houston et al.

(10) Patent No.: US 6,257,565 B1
(45) Date of Patent: Jul. 10, 2001

(54) DECKING CLAMP AND METHOD OF MAKING THE SAME

(75) Inventors: Bennick G Houston, Cumming; Max D. Earwood, Jr., Winder; Billy W. Jones, Lawrenceville, all of GA (US)

(73) Assignee: Cherokee Metals Company, Norcross, GA (US)

( * ) Notice: Subject to any disclaimer, the term of this patent is extended or adjusted under 35 U.S.C. 154(b) by 0 days.

(21) Appl. No.: 09/491,947

(22) Filed: Jan. 26, 2000

(51) Int. Cl.[7] ..... B25B 5/00
(52) U.S. Cl. ..... 269/249; 269/248; 269/251
(58) Field of Search ..... 269/249, 251, 269/248, 173, 174, 181, 182; 24/514, 569, 522, 525; 403/344, 290, 373

(56) References Cited

U.S. PATENT DOCUMENTS

| | | | | |
|---|---|---|---|---|
| 2,949,140 | * | 8/1960 | Larson | 269/249 |
| 3,147,003 | * | 9/1964 | Johnson | 269/249 |
| 4,155,206 | | 5/1979 | Player . | |
| 4,417,431 | | 11/1983 | Commins et al. . | |
| 4,476,659 | | 10/1984 | Player . | |
| 4,543,760 | | 10/1985 | Burker et al. . | |
| 4,575,983 | | 3/1986 | Lott, Jr. et al. . | |
| 4,796,403 | | 1/1989 | Fulton et al. . | |
| 5,511,354 | | 4/1996 | Eidson . | |

* cited by examiner

*Primary Examiner*—Derris H. Banks
*Assistant Examiner*—Daniel Shanley
(74) *Attorney, Agent, or Firm*—Troutman Sanders LLP; Wm. Brook Lafferty

(57) ABSTRACT

A decking clamp for use in an underhung roof system. The clamp includes a housing having a cavity. The cavity is offset in the housing to define an opening into the cavity. The housing includes a fastening retention channel which communicated with the opening into the cavity of the clamp. A removable thread rests within the channel. The channel and removable thread are configured for receiving a fastener. The opening leading to the cavity may be narrowed with the fastener when the fastener is received in the removable thread and channel. The housing itself is free of threading and the removable thread may be removed from the housing and replaced with another removable thread.

12 Claims, 5 Drawing Sheets

DECKING CLAMP AND METHOD OF MAKING THE SAME

TECHNICAL FIELD

The present invention relates to underhung roof systems and, more specifically, to the decking clamps used in securing ceiling panels to the ceiling support structure.

BACKGROUND OF THE INVENTION

Currently, there is a myriad of decking clamps available to the installer for use in the hanging of underhung roof systems. The underhung roof systems are assembled by placing ceiling panels alongside one another in a side-by-side relationship. The edges of the panels have upstanding legs that run along the length of each panel. The legs have interlockable flanges that are sized to allow the leg of one panel to fit inside the leg of an adjacent panel such that the edges of adjacent panels overlap one another.

The panels with joined legs are hung from the ceiling support structure, which typically includes I-beams, in a perpendicular manner relative to the length of the I-beams. Each time the length of a pair of joined legs intersects with an I-beam, a decking clamp may be used to secure the panels to the I-beam.

Known decking clamps are substantially C-shaped so that the combined legs of adjacent panels, along with the flanged portion of the I-beam, may be inserted into the opening of the clamp. Each clamp includes a threaded channel through an upper portion of the clamp that is sized for receiving a bolt. Once the legs of the panels and the flanged portion of the I-beam are inside the clamp, the bolt is tightened down onto the I-beam and panels.

The C-shaped clamp may be made in a number of ways. Typically, however, the best way to make such clamps is any way which permits the manufacturer to make the clamp with the minimum number of steps in the minimum amount of time. If a manufacturer could eliminate a step in the manufacturing process, considerable expense and time could be saved so that countless more clamps could be made. Typically, decking clamps are made in a progressive die by stamping out a clamp blank similar to that shown in FIG. 1.

It is known to those skilled in the art to provide threading in the channel of the clamp. The threading is created on a portion of the clamp blank by an off-line procedure after the clamp blank is removed from the die. The threading is then used to receive and retain a corresponding threaded bolt. However, other techniques have been attempted to manufacture clamps without threading to reduce the number of stages and amount of time required to manufacture a clamp.

For example, in an attempt to eliminate the off-line threading procedure, the present inventors attempted to include an additional stage in the stamping die to create a pair of misaligned seams 20 on a clamp blank 22 as shown in FIG. 2. As shown in FIG. 3, the clamp blank was rolled onto itself, in a manner known in the industry, to create a retention channel 24 between the two opposed sides of the clamp blank 22. By rolling the clamp blank 22, the portion of the clamp blank defined between the seams becomes bowed and defines a circumferential portion 26 of the channel as best shown in FIG. 4. A self-threading bolt (not shown) was then inserted into the channel 24 against the circumferential portion 26 of the clamp blank 22 by using a high torque drill press. As a result of driving the self-threading bolt through the channel 24, threads (not shown) were created on the channel 24 including the circumferential portion 26.

However, it was often difficult to drive the self-threading bolt into the channel 24 in an accurate and easy manner. Moreover, once the fastener had been driven into the channel, it was difficult to tighten down onto the I-Beam and panels. Also, once the decking clamp had been tapped with the self-threading fastener, the threads were permanently placed on the clamp. Thus, if the threads become damaged or misaligned, the clamp could no longer be used and must be discarded.

Therefore, there is a need in the clamp manufacturing industry for an improved clamp which may be manufactured in the fewest possible number of steps and which may be more effectively used by underhung roof installers with considerable easy.

SUMMARY OF THE INVENTION

The present invention solves the above-identified problem by providing an improved decking clamp. The improved decking clamp may be manufactured in a fewer number of steps and may be more easily utilized by underhung roof installers.

Generally described, the decking clamp of the present invention includes a housing with an intermediately disposed cavity. The cavity has an offset periphery in the housing to define a first opening into the cavity. The clamp further includes a fastening retention channel in the housing and within the retention channel rests a removable thread. To use the clamp, a fastener is received in the retention channel and in the removable thread for narrowing the first opening around a portion of the ceiling panels and ceiling support structure.

In one aspect of the present invention, the clamp further includes a second opening in the housing that is laterally displaced from the second opening. The first and second openings communicate with the retention channel and the second opening is sized for receiving the removable thread.

More particularly described, the removable thread is preferably a threaded nut and the fastener is a bolt. When the nut is received and retained in the second opening, the nut is axially aligned with the retention channel to receive the bolt.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 5:
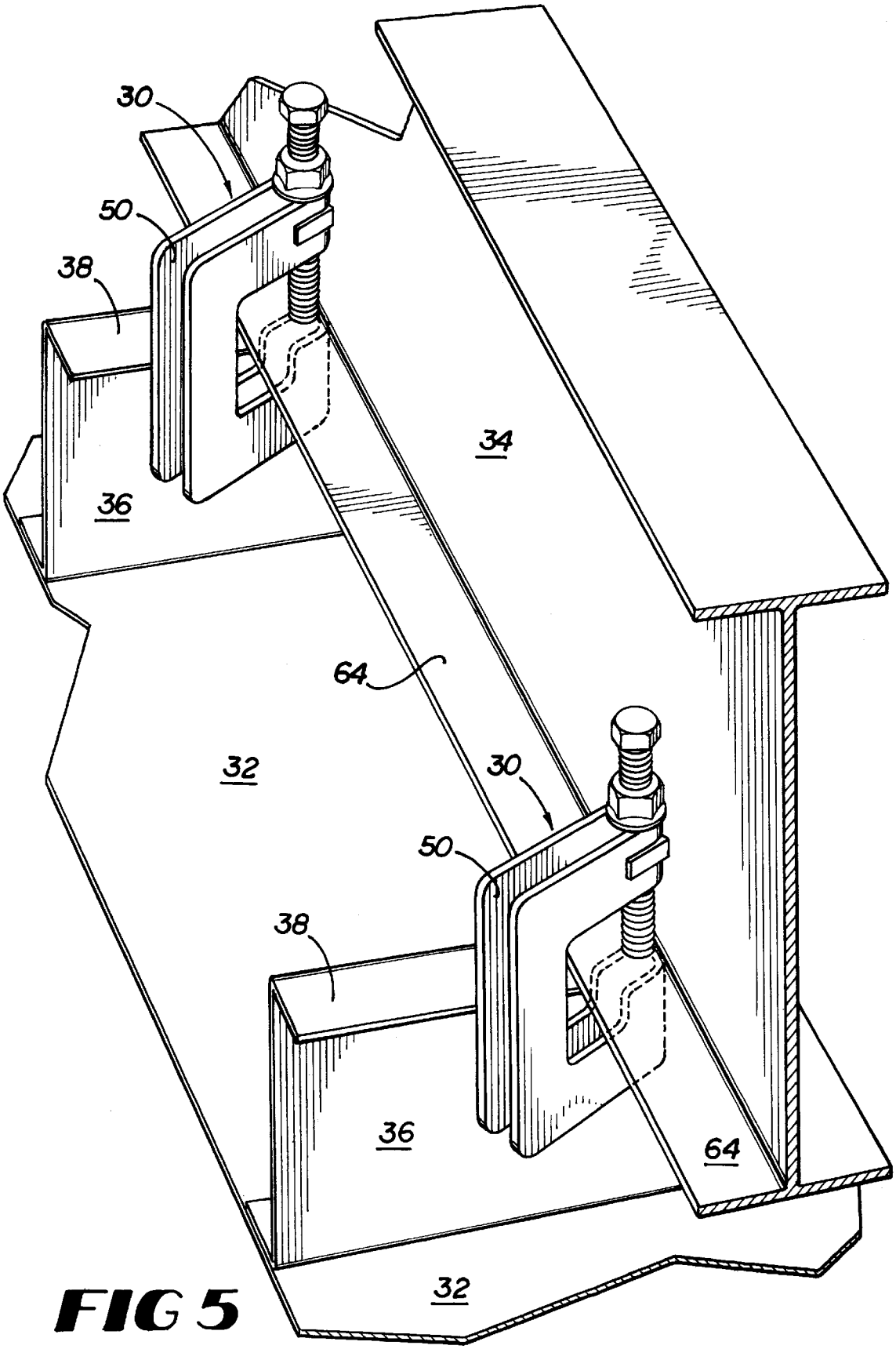
FIG. 5 is a perspective view illustrating one embodiment of two decking clamps of the present invention for securing decking panels to an I-beam of a ceiling support structure.

Referring now to the drawings in which like numerals indicate like elements throughout the several views, FIG. 5 depicts one embodiment of a pair of decking clamps 30 utilized to secure interlocking ceiling panels 32 to an I-beam 34 of a ceiling support structure to form an underhung roof system. The underhung roof systems are assembled by placing the ceiling panels 32 alongside one another in a side-by-side relationship. The edges of the panels 32 have upstanding legs 36 that run along the length of each panel. The legs 36 have interlockable flanges 38 that are sized to allow the leg of one panel to fit inside the leg of an adjacent panel such that the edges of adjacent panels overlap one another.

Figure 1:
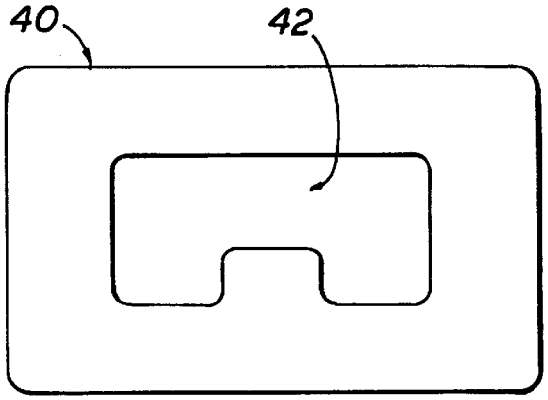
(PRIOR ART) FIG 1
FIG. 1 is a top view of a stamped clamp blank capable of being rolled onto itself to form a substantially C-shaped decking clamp.
Figure 2:
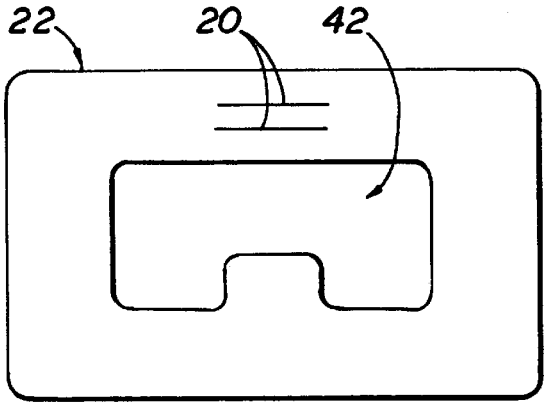
(PRIOR ART) FIG 2
FIG. 2 is a top view of the stamped clamp blank of FIG. 1 having a pair of stamped, parallel misaligned seams.
Figure 3:
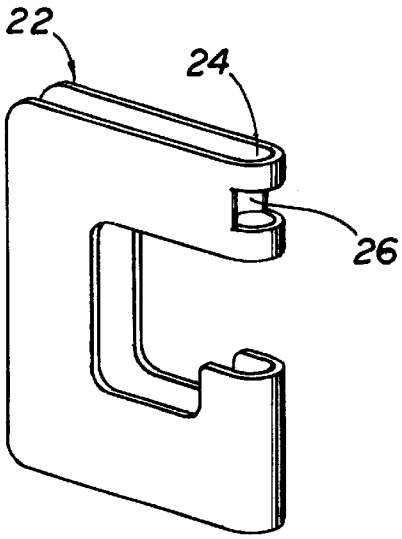
(PRIOR ART) FIG 3
FIG. 3 is a perspective view of a decking clamp formed from the clamp blank of FIG. 2.
Figure 4:
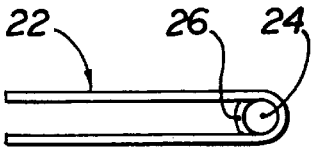
(PRIOR ART) FIG 4
FIG. 4 is a top view of the decking clamp of FIG. 3.
Figure 6:
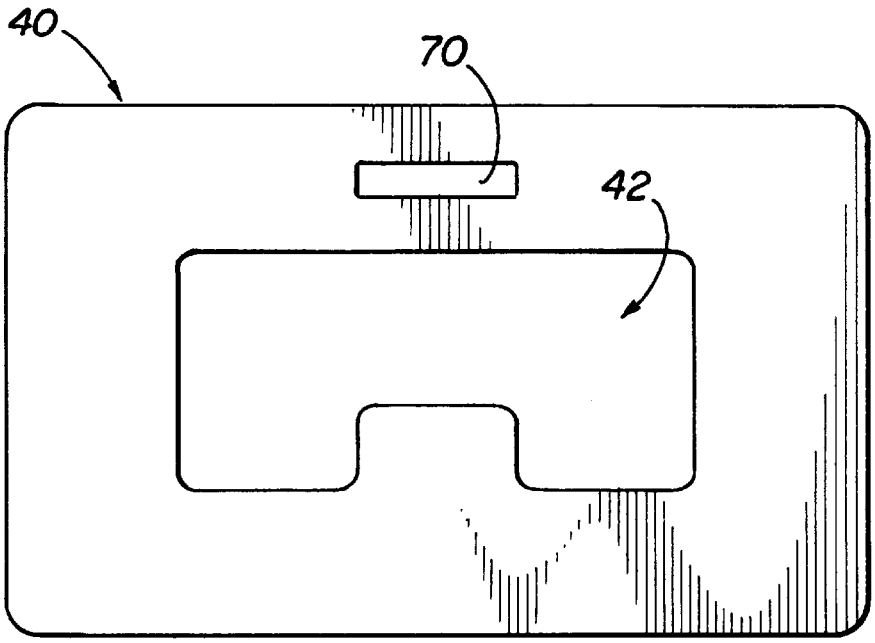
FIG. 6 is a top view of a stamped clamp blank of the present invention having a stamped slot.
Figure 7:
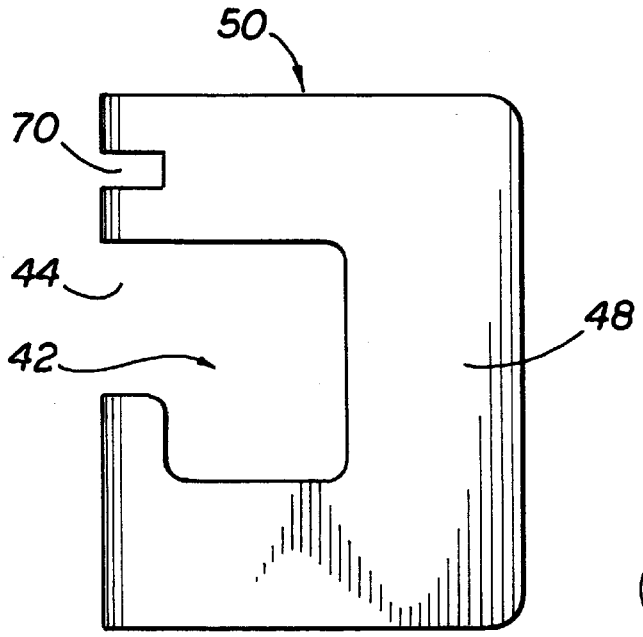
FIG. 7 is a side view of the stamped clamp blank of FIG. 6 having been rolled onto itself to form substantially a C-shaped decking clamp.
Figure 8:
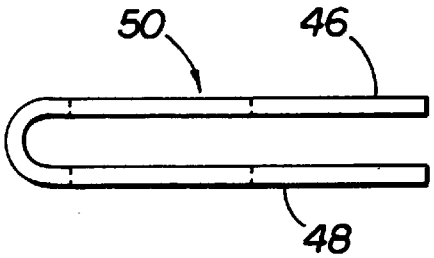
FIG. 8 is a top view of the decking clamp of FIG. 7.
Figure 9:
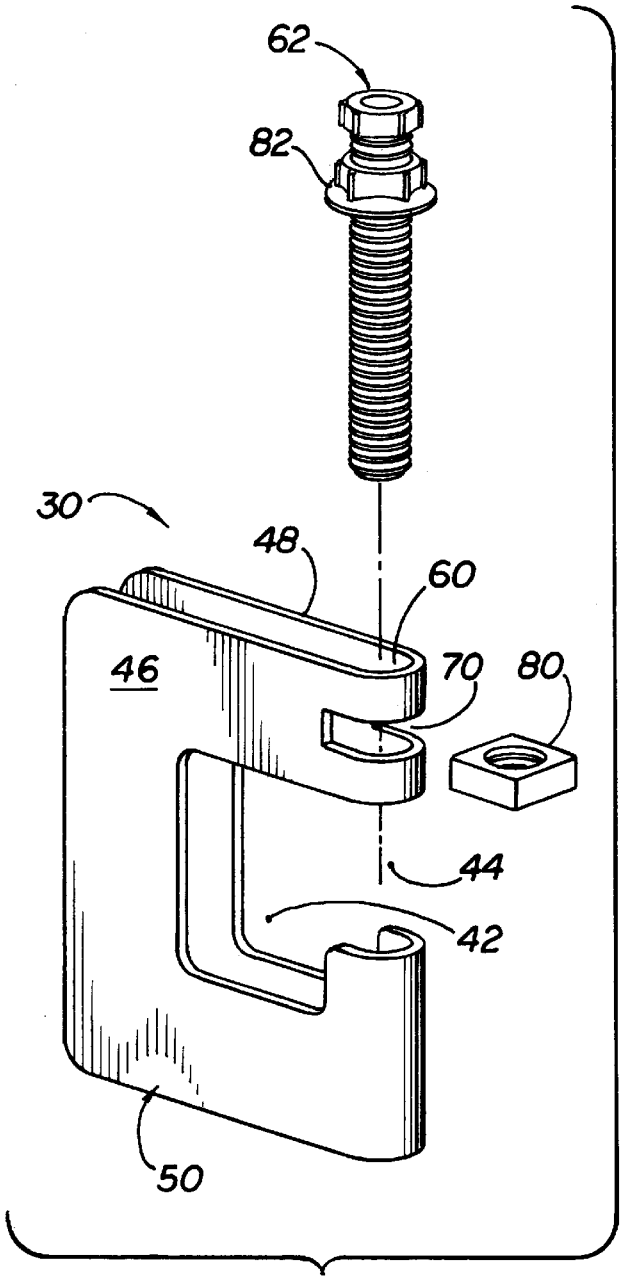
FIG. 9 is a perspective view of one embodiment of the clamp of the present invention formed from the clamp blank of FIG. 6 and having a bolt with corresponding nut removed from the housing.

FIG. 6 illustrates a clamp blank 40. The clamp blank 40 may be made from a coil of 12-gauge galvanized steel, or other suitable material, indexed into a progressive stamping die that is housed in a stamping press. The die and stamping press perform a number of simultaneous stamping procedures known as stages to create various features in the clamp blank 40 such as an intermediately disposed cavity 42 shown in FIGS. 1, 2 and 6. The clamp blank 40 with the cavity 42 may be rolled onto itself such that the cavity 42 has an offset periphery defining a first opening 44 into the cavity 42 as best shown in FIG. 7. When rolled, the clamp 30 has a first side portion 46 and a second side portion 48, which oppose one another, to define a substantially C-shaped housing 50. FIGS. 8 and 9 best illustrate the first and second side portions 46, 48 of the housing 50. A retention channel 60 is defined in the housing 50 between the opposed first and second side portions 46, 48. The retention channel 60 preferably communicates with the first opening 44 to allow a fastener 62, such as a common hex head bolt, received in the retention channel 60 to extend downwardly through a portion of the housing 50 into the first opening 44 and into contact with a flange 64 (FIG. 5) of the I-beam 34 (FIG. 5) or other contact surface of a ceiling support structure. FIG. 5 illustrates the bolt coming into contact with the flange 64 of the I-beam 34. By extending downwardly into the housing 50 and into the first opening 44, the fastener 62 may narrow the first opening 44 in order to contact the flange 64 of the I-beam 34.

Referring now to FIGS. 6, 7 and 9, the die and stamping press also stamp out a second opening 70, commonly referred to as a slot. The slot 70 preferably communicates with the retention channel 60. The slot 70 is distinguishable from the pair of misaligned slots 20 (FIG. 2) described above in that the material between the pair of misaligned seams 20 (FIG. 2) is completely removed to form the slot 70. The slot 70 is preferably laterally displaced from the first opening 44.

Figure 10:
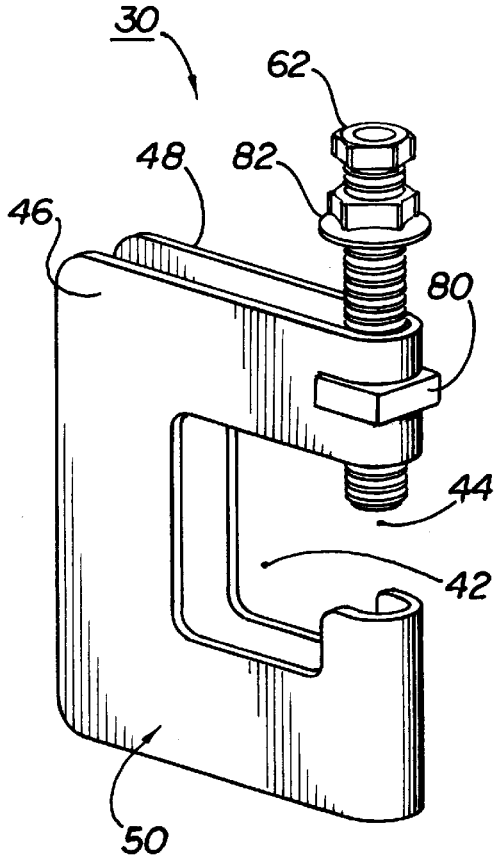
FIG. 10 is a perspective view of the clamp of FIG. 9 with the bolt and nut received in the housing of the clamp.

Turning now to FIGS. 9 and 10, the decking clamp 30 of the present invention further comprises a removable thread 80 which is to rest within the channel 60. The removable thread 80 is preferably a common square nut sized to be received and retained in the slot 70 in an axially aligned manner relative to the channel 60. Therefore, the configuration of the slot 70 should be predefined for the desired removable thread 80 such that the removable thread corresponds with the channel 60. Also, the removable thread 80 is preferably laterally displaced from the first opening 44 when retained in the slot 70. When the removable thread 80 is retained in the slot 70, the removable thread 80 is not free to move relative to the housing 50, other than to be removed completely from the slot 70 and the housing 50. When the removable thread 80 is removed from the slot 70, the housing 50 is otherwise free of threading. On occasion, it may be desirable to remove the removable thread 80 from the slot 70 of the housing 50 and replace it with another removable thread 80. However, for the removable thread 80 to be removed from the slot 70, the fastener 62 must be releasably connected to the removable thread 80. For example, if the clamp 30 was to be reused, the installer may wish to replace the old nut with a new nut prior to receiving the fastener 62 back into the retention channel 60.

FIG. 9 illustrates, in particular, the clamp 30 formed from the clamp blank 40 of FIG. 6 and the bolt 62 with the corresponding nut 80 removed from the housing 50. On the other hand, in FIG. 10, the bolt 62 is received into the retention channel 60 formed between the rolled side portions of the clamp blank 40. The bolt 62 is then threaded into the removable thread 80. On the bolt 62 is a serrated flange lock nut 82. Once the clamp 30 is placed onto the decking panels 32 and I-beam 34 to secure panels 32 and the I-beam 34 together (FIG. 5), the lock nut 82 is twisted down over the bolt and into contact with the housing 50 to lock the bolt 62 into place and to prevent the bolt 62 from rotating relative to the removable thread 80.

Figure 11:
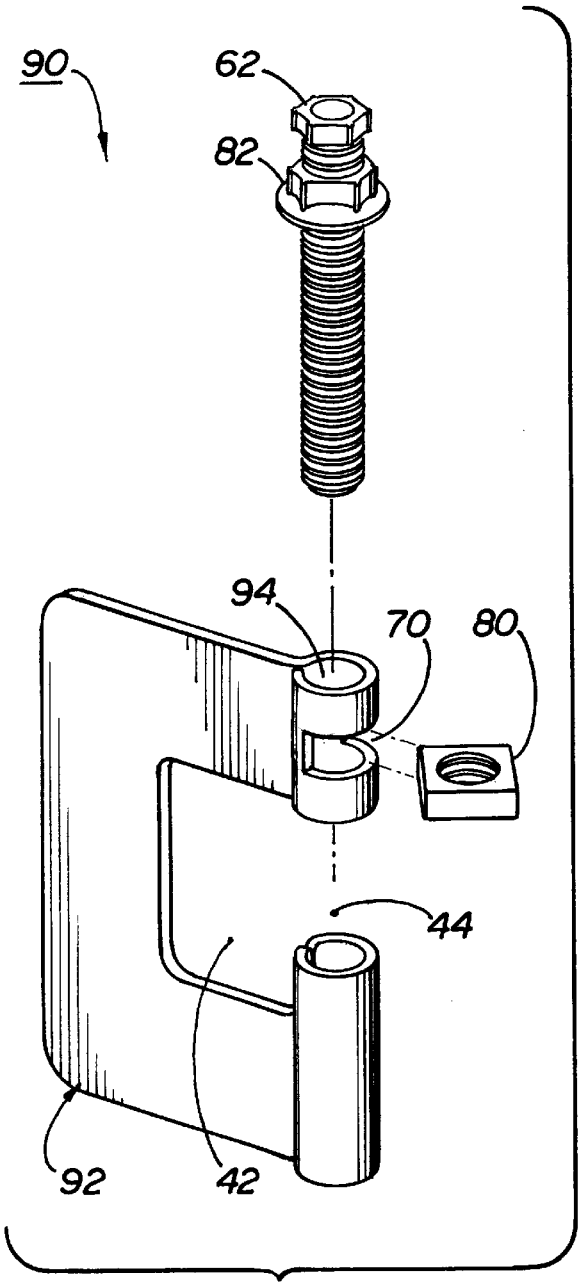
FIG. 11 is a perspective view of an alternative embodiment of the present invention having a bolt with corresponding nut removed from the housing.
Figure 12:
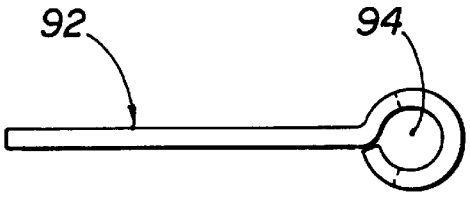
FIG. 12 is a top view of the housing of the clamp of FIG. 11.
Figure 13:
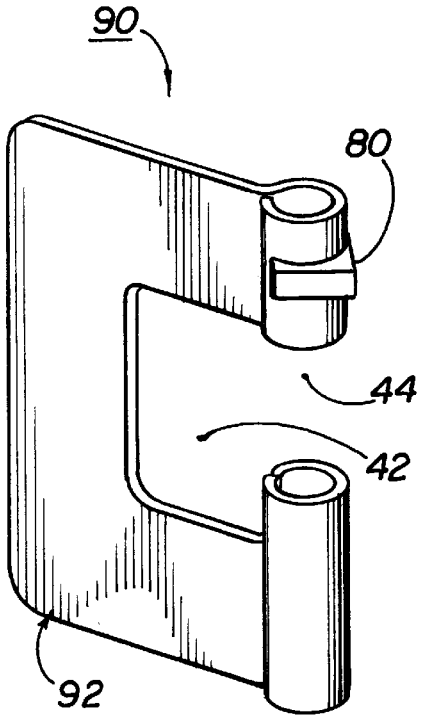
FIG. 13 is a perspective view of the alternative embodiment with the nut in the housing.

FIGS. 11–13 illustrate an alternative embodiment of the present invention. In particular, FIGS. 11–13 illustrate a clamp 90 having a housing 92. The configuration of the housing 92 itself with a channel 94 is known in the art. However, as described above, the clamp 90 includes a slot 70 for receiving and retaining a removable thread 80, such as a nut. FIG. 11 illustrates the clamp 90 with the bolt 62 and corresponding removable thread 80 removed from the housing 92 and FIG. 13 illustrates the clamp 90 and corresponding removable thread 80 in the housing 92 for receiving a bolt (not shown).

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A clamp comprising:

a housing;

an intermediately disposed cavity in said housing, said cavity having an offset periphery defining a first opening into said cavity;

a fastening retention channel in said housing; and a removable thread for resting within said channel, said removable thread being non-rotateable relative to said housing when resting within said channel.

2. The clamp of claim 1 wherein said retention channel communicates with said first opening.

3. The clamp of claim 1 further comprising a second opening in said housing sized for receiving said removable thread and which communicates with said channel.

4. The clamp of claim 3 wherein said removable thread is a threaded nut, said nut being axially aligned with said channel when said nut is received and retained in said second opening of said housing.

5. The clamp of claim 1 wherein said clamp is free of threading when said removable thread is removed from said housing.

6. The clamp of claim 1 further comprising a threaded fastener capable of being received through said housing, said fastener narrowing said first opening when said fastener is threaded into said housing.

7. The clamp of claim 6 wherein said fastener is a bolt.

8. The clamp of claim 1 wherein said removable thread is removed from said housing and replaced with another removable thread.

9. The clamp of claim 1 wherein said first opening is laterally displaced from said second opening.

10. The clamp of claim 1 wherein said removable thread is laterally displaced from said first opening.

11. A decking clamp for securing decking panels to a ceiling support structure, said decking clamp comprising:

a substantially C-shaped housing, said housing being free of threading;

an intermediately disposed cavity in said housing, said cavity having an offset periphery defining a first opening into said cavity;

a fastening retention channel in said housing and communicating with said first opening; and a second opening in said housing sized for receiving and retaining a removable thread, and said removable thread being axially aligned with said channel when said removable thread is received and retained in said housing.

12. A clamp comprising:

a housing having opposing first and second portions;

an intermediately disposed cavity in said housing, said cavity having an offset periphery defining a first opening into said cavity;

a fastening retention channel defined between said first and second portions of said housing; and a removable thread resting within said channel.

* * * * *